US005682996A

United States Patent [19]

Le Bras

[11] Patent Number: 5,682,996

[45] Date of Patent: Nov. 4, 1997

[54] CARRIER FOR BRICK-TYPE CONTAINERS

[75] Inventor: Philippe Le Bras, Chateauroux, France

[73] Assignee: The Mead Corporation, Dayton, Ohio

[21] Appl. No.: 792,477

[22] Filed: Feb. 27, 1997

Related U.S. Application Data

[63] Continuation of Ser. No. 376,171, Jan. 18, 1995, abandoned.

[51] Int. Cl.[6] ..... B65D 75/04

[52] U.S. Cl. ..... 206/429; 206/431

[58] Field of Search ..... 206/427, 429, 206/431, 434, 435; 229/117.09, 117.12, 117.13

[56] References Cited

U.S. PATENT DOCUMENTS

| | | | |
|---|---|---|---|
| 2,675,264 | 4/1954 | Vander Lugt, Jr. | 206/431 X |
| 2,764,284 | 9/1956 | Arneson | 206/147 |
| 2,823,062 | 2/1958 | Toensmeier | 294/87.2 |
| 2,823,064 | 2/1958 | Toensmeier | 294/87.2 |
| 2,946,436 | 7/1960 | Williamson | 206/141 |
| 3,670,879 | 6/1972 | Williard et al. | 206/431 |
| 4,671,451 | 6/1987 | Yeaman, Sr. | 229/40 |
| 4,693,412 | 9/1987 | Yeaman, Sr. | 229/40 |
| 4,989,778 | 2/1991 | Saulas | 229/117.13 |
| 5,004,104 | 4/1991 | Saulas | 206/526 |
| 5,135,104 | 8/1992 | Jorba | 206/151 |
| 5,518,117 | 5/1996 | Eriksen | 206/431 |

FOREIGN PATENT DOCUMENTS

| | | |
|---|---|---|
| 0 060 504 | 9/1982 | European Pat. Off. . |
| 1 286 211 | 8/1972 | United Kingdom . |
| WO93/22218 | 11/1993 | WIPO . |

*Primary Examiner*—Jacob K. Ackun
*Attorney, Agent, or Firm*—Thomas A. Boshinski

[57] ABSTRACT

A carrier is provided for a brick-type container. The brick includes interconnected side and end walls, and an upper closure structure having folded portions overlapping and extending downwardly along a portion of each of the end walls. The carrier includes a top wall panel, a pair of side wall panels foldably connected to the top wall panel, and a pair of retention strips substantially vertically disposed and extending between the side wall panels. Each of the retention strips defines an upper free edge spaced from the top wall panel. The retention strips are foldably connected to the side wall panels, whereby the side wall panels and the retention strips together surround the brick and the free edges engage a lowermost end of the folded portions of the upper closure structure of the brick.

13 Claims, 4 Drawing Sheets

CARRIER FOR BRICK-TYPE CONTAINERS

This application is a continuation of application Ser. No. 08/376,171 filed Jan. 18, 1995, now abandoned.

BACKGROUND OF THE INVENTION

The present invention relates generally to paperboard carriers for containers of the brick type and, more particularly, to such a carrier that can be clipped onto the top portion of one or more bricks.

Liquid and other fluid products such as juices, milk, fruit drinks and the like are often packaged in parallelepiped containers formed from coated paperboard and generally known as bricks. The brick includes generally vertical side and end walls that form a rectangular tube. The bottom end of the tube is folded and sealed, while the top end is kept open for filling. After filling, the top of the tube is closed by folding the tube to form an overlapped sealing seam parallel to the side walls. The seam is then folded downwardly onto the tube top. The end portions of the seam extend beyond the end walls and are therefore folded onto the end walls forming triangular end flaps.

Examples of brick-type packages can be seen by reference to U.S. Pat. Nos. 5,118,036 and 5,188,285.

As with other primary containers, it is often desirable to form a package of multiple bricks by placing the bricks into a carton or applying a carrier to the bricks. A number of cartons of the wraparound type especially adapted for bricks are known. Examples can be seen by reference to U.S. Pat. Nos. 4,989,778 and 5,004,104.

In packaging primary containers of various types, it may in some cases be useful to utilize a carrier of the clip type. Such a carrier engages the upper portion of the container or containers, and usually leaves the lower container portion exposed. Such clips are often used to package, for example, bottles or cups. While clips envelope less than all of the packaged containers, clips can possess important cost and/or paperboard saving in that less paperboard material is required. Further, the exposed portions of the packaged containers can be used to advantage in promoting the product, for example where the containers are printed with attractive graphics or have a unique shape. Examples of clips can be seen by reference to U.S. Pat. Nos. 3,860,281 and 4,318,476.

However, a need remains for a clip-type carrier that can successfully be used with bricks. Such a clip should possess the advantages typically associated with clips, such as economy or high visibility of the packaged product and should be reliably and simply attached to the top portion of the bricks to be packaged.

SUMMARY OF THE INVENTION

In accordance with the present invention, a carrier is provided for a brick-type container. The brick includes interconnected side and end walls, and an upper closure structure having folded portions overlapping and extending downwardly along a portion of each of the end walls. The carrier includes a top wall panel, a pair of side wall panels foldably connected to the top wall panel, and a pair of retention strips substantially vertically disposed and extending between the side wall panels. Each of the retention strips defines an upper free edge spaced from the top wall panel. Means is provided for foldably connecting the retention strips and the side wall panels, whereby the side wall panels and the retention strips together surround the brick and the free edges engage a lowermost end of the folded portions of the upper closure structure of the brick.

The foldably connecting means may include a pair of gusset panels for each of the retention strips, one of the gusset panels of each pair connecting the retention strip with one of the side wall panels. The gusset panels may be of generally triangular configuration and may be foldably connected to the retention strip so as to be positioned in overlapping relationship with the associated one of the side wall panels.

In accordance with another form of the invention, a carrier is provided for two or more of the brick-type containers. The bricks are disposed linearly in end-wall to end-wall arrangement, and the carrier includes a top Wall panel, and a pair of side wall panels foldably connected to the top wall panel. First and second retention strips are substantially vertically disposed and extend between the side wall panels at opposite ends of the side wall panels. Third and fourth retention strips are substantially vertically disposed and positioned in mutually overlapped relationship, the third and fourth retention strips extending between the side wall panels and being disposed intermediate the first and second retention strips. The retention strips each define an upper free edge spaced from the top wall panel. Means is provided for foldably connecting the retention strips and the side wall panels, whereby the side wall panels and the first and third retention strips surround one of the bricks and the side wall panels and the second and fourth retention strips surround the other one of the bricks, the free edges of the retention strips each engaging a lowermost end of the respective one of the folded portions of the upper closure structure of the bricks.

In this embodiment, the foldably connecting means may include a pair of gusset panels for each of the retention strips, one of the gusset panels of each pair connecting the retention strip with one of the side wall panels. The gusset panels may be of generally triangular configuration and are foldably connected to the retention strip so as to be positioned in overlapping relationship with the associated one of the side wall panels. In addition, the second and third retention strips are connected along a lower edge thereof by a fold line.

In accordance with still another form of the invention, a package of the aforementioned container is formed. The package includes the container and a carrier disposed on the container. The carrier is provided with means for engaging the folded portions of the upper closure structure of the container so that the container and the carrier are retained together when the carrier is lifted.

The carrier may have a pair of side wall panels disposed alongside the respective upper portions the side walls of said container. The engaging means may include a pair of retention strips connecting and extending between the side wall panels and disposed under the respective lower edges of the folded portions of the upper closure structure of the container.

DETAILED DESCRIPTION OF THE PREFERRED EMBODIMENT

Figure 1:
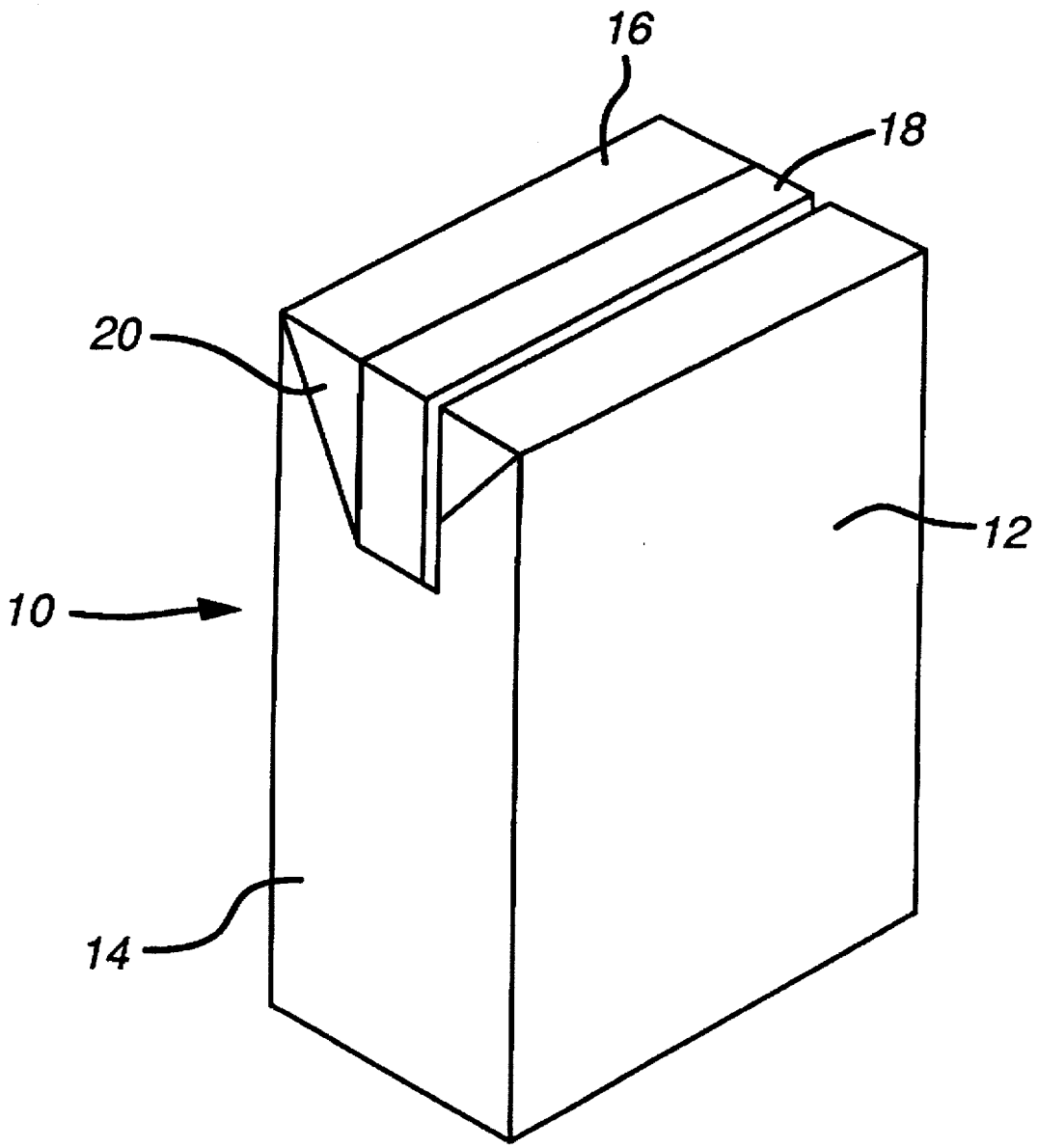
FIG. 1 is a perspective view of a brick-type container with which the present invention may be used.

A typical brick-type container for liquids or other fluids is shown in FIG. 1. The brick 10 includes substantially vertical side walls 12 and connected end walls 14. An upper end closure structure 16 is formed by folding the uppermost portions of side walls 12 into contact and forming a sealed seam 18 which may be folded onto itself for additional sealing strength. The seamed portion is then folded flat onto the top of the brick. Triangular end portions 20 which are thus created are then folded downwardly to extend along an upper portion of end walls 14.

Figure 2:
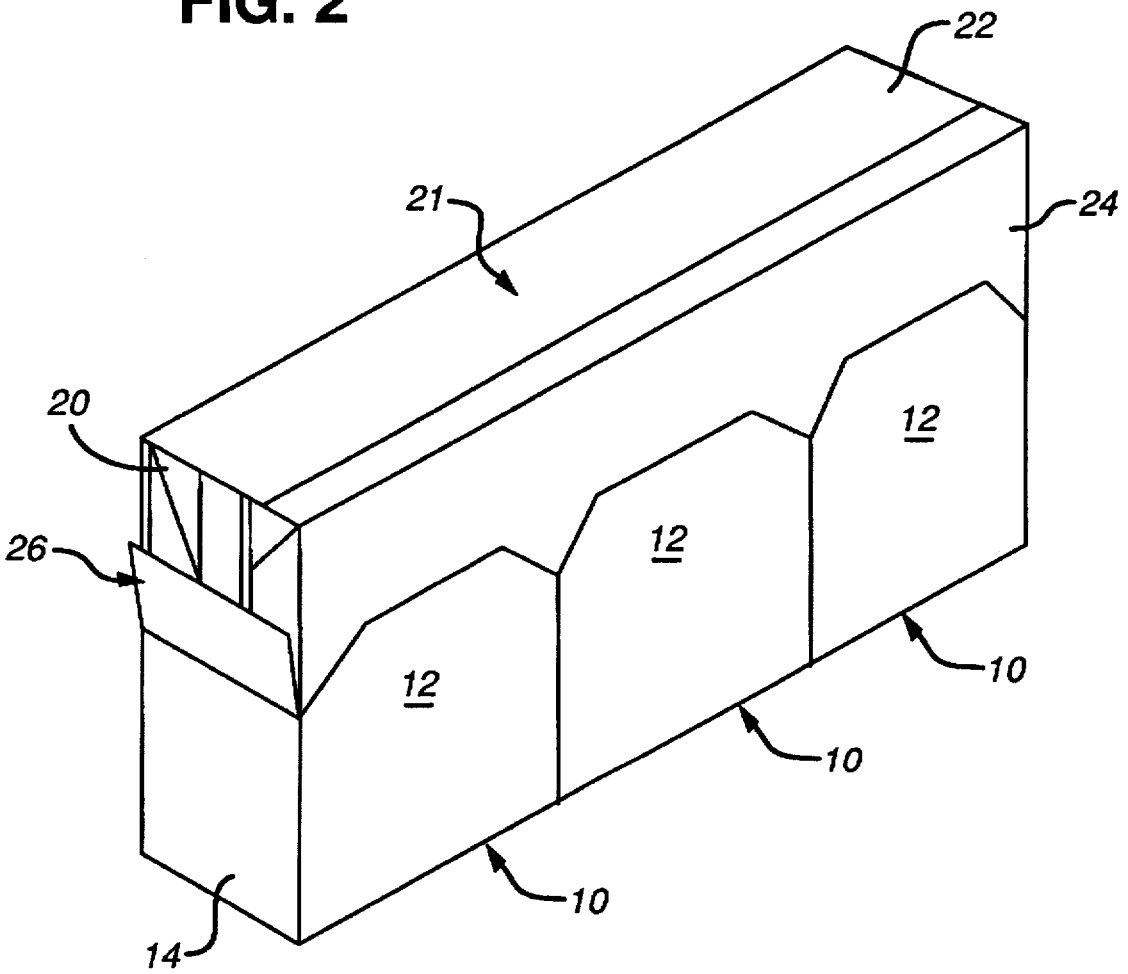
FIG. 2 is a perspective view of a completed package in which a carrier in accordance with the present invention is used.

A carrier for bricks of this type is shown in FIG. 2. The carrier is of the top-gripping or clip type and includes a top wall panel 22 positioned over the tops of the bricks to be packaged. A pair of side wall panels 24 extend downwardly along the side walls of the bricks. End structure 26 is positioned at the end of the bricks and is connected to the side wall panels 24, as will be described.

Figure 3:
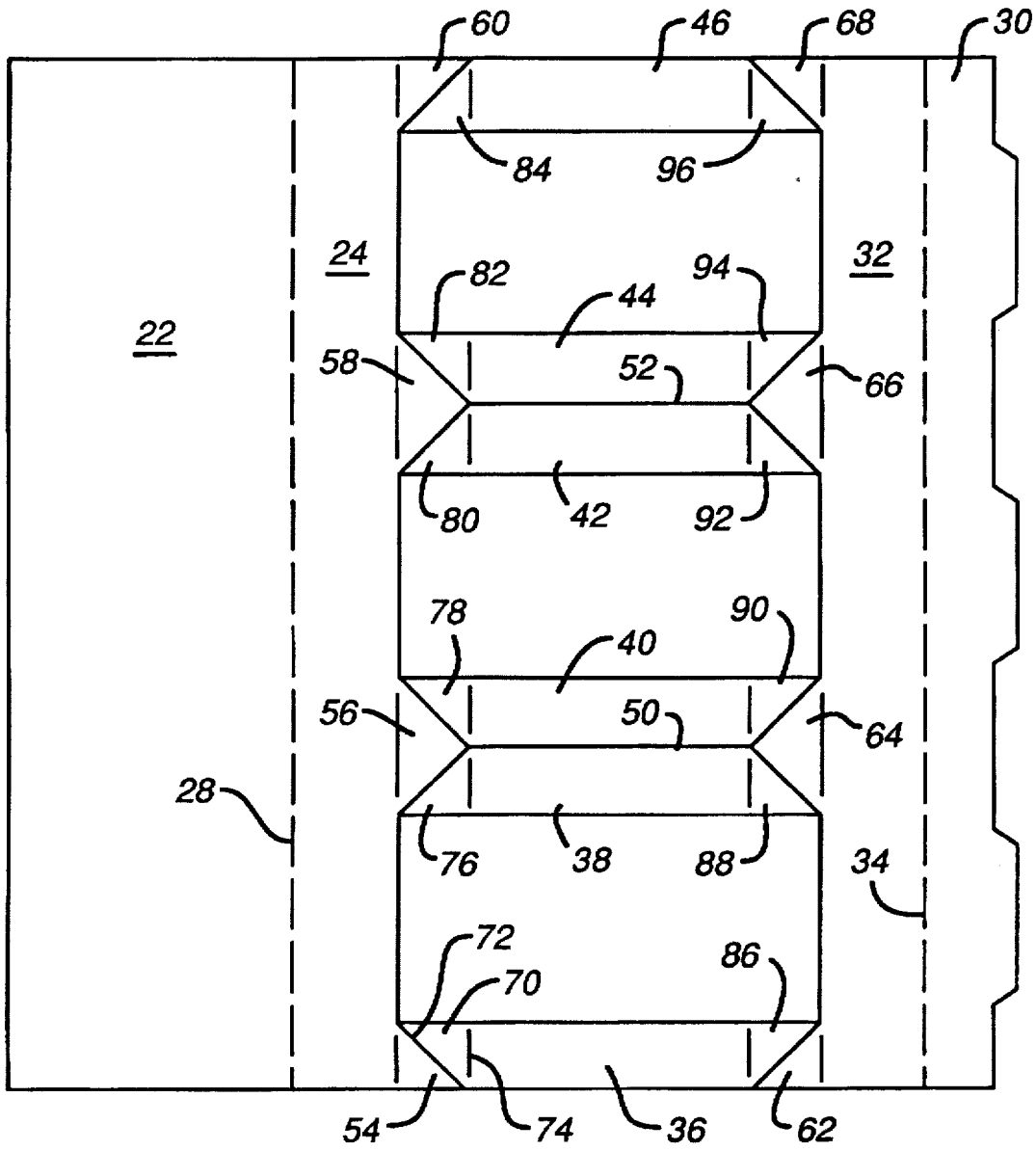
FIG. 3 is a plan view of a blank for forming the carrier shown in FIG. 2.

The blank for forming the carrier can be seen by reference to FIG. 3. Top wall panel 22 is connected to side wall panel 24 along a fold line 28. At the opposite end of the blank, a glue flap 30 is connected to the second side wall panel 32 along a fold line 34.

Side wall panels 24 and 32 are connected by structure including a plurality of retention strips 36, 38, 40, 42, 44 and 46 respectively. Strips 38 and 40 are connected along a fold line 50, while strips 42 and 44 are connected along a fold line 52. A plurality of triangular connection portions 54, 56, 58 and 60 extend from the edge of side wall panel 24, and a similar plurality of triangular connection portions 62, 64, 66 and 68 extend from the edge of side wall panel 32.

Triangular connection portion 54 is connected to a gusset panel 70 by a fold line 72, and gusset panel 70 is in turn connected to retention strip 36 by a fold line 74. Gusset panel 76 connects in a similar manner between triangular connection portion 56 and retention strip 38 and gusset panel 78 connects between triangular connection portion 56 and retention strip 40. In a like manner gusset panels 80 and 82 connect triangular connection portion 58 to retention strips 42 and 44 respectively. Additional gusset panels 84, 86, 88, 90, 92, 94 and 96 connect triangular connection portions 60, 62, 64, 66 and 68 to their respective retention strips as shown in FIG. 3.

Figure 4:
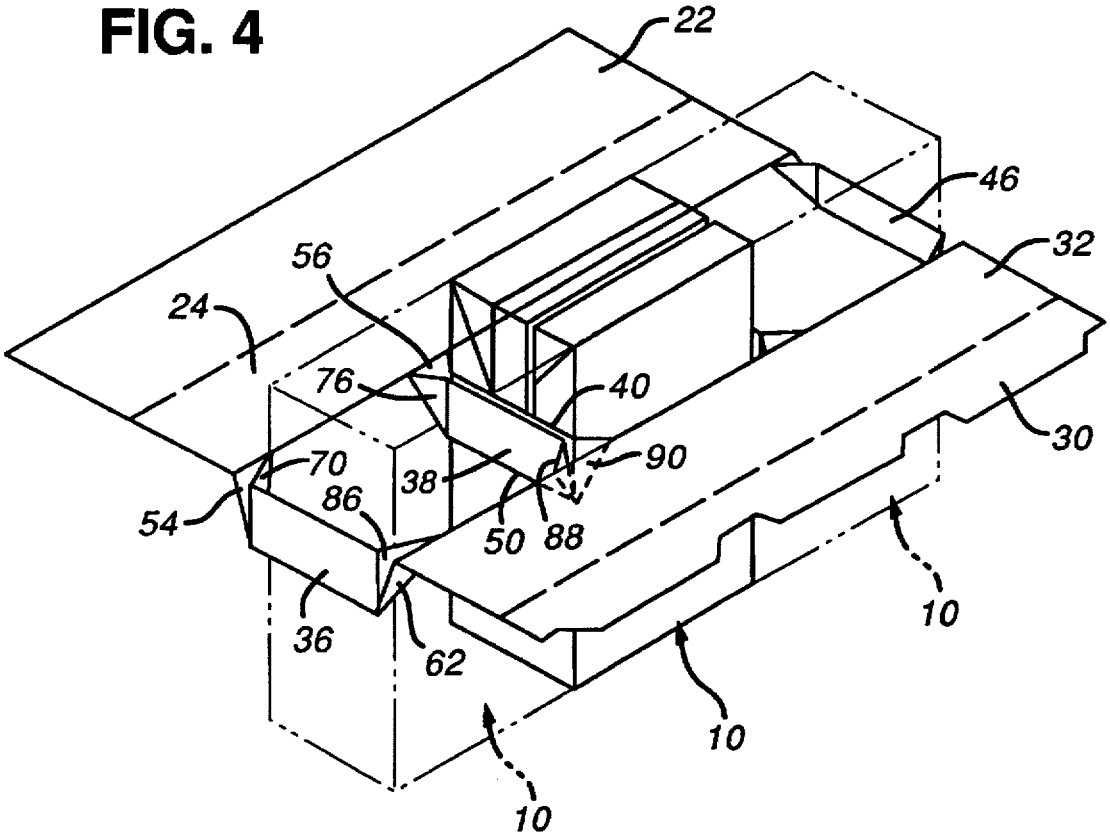
FIG. 4 is a perspective view of the carrier shown partially applied to a group of bricks to be packaged.

The manner in which bricks 10 may be secured within the carrier can be seen by reference to FIG. 4. Retention strips 38 and 40 are folded into overlapping arrangement along fold line 50. This folding brings gusset panels 76, 78, 88 and 90 into face contact with the respective triangular connection portions 56 and 64, with the result that retention strips 38 and 40 are placed into substantially vertical orientation, perpendicular to side wall panels 24 and 32 in the completed carrier.

An identical folding operation is performed for retention strips 42 and 44.

Retention strip 36 is erected into a substantially vertical orientation in a similar manner, by folding gusset panels 70 and 86 onto their respective triangular connection portions. Retention strip 46 is erected into position in like fashion.

Erecting of the retention strips creates openings into which bricks 10 may be inserted as shown in FIG. 4. (The centermost brick is shown in the figure, with the other bricks shown in phantom for clarity.) The adjacent retention strips 40 and 42 (strip 42 is not visible in FIG. 4) are disposed adjacent the end walls of the brick, while the side wall panels 24 and 32 of the carrier are thereafter moved into position adjacent the side walls 12 of brick 10. The retention strips 40 and 42 are engaged beneath the lower end of the seam extending along the triangular end portion 20 of the top closure for the brick.

To complete the carrier, side wall panels 24 and 32 are moved into position against the bricks. Glue flap 30 is folded over the tops of the bricks, and top wall panel 22 is then folded into overlapping position. Glue applied between glue flap 30 and top wall panel 22 secures the carrier in place.

Each of the retention strips 36, 38, 40, 42, 44 and 46 is engaged beneath the end portion of the seam of the respective brick in the completed carrier. Thus, the carrier cannot be moved upwardly with respect to the packaged bricks, and the bricks will be retained in the carrier when lifted. At the same time, top wall panel 22 prevents the carrier from being moved downwardly with respect to the bricks, thereby holding the carrier in place when the package is for example resting on a flat surface.

The carrier may be preferably applied over the tops of the bricks, which have been previously arranged in proper position. The carrier is moved downwardly until the retention strips pass the lower ends of the brick seams. The carrier is then raised to engage the strips with the seams, whereafter the carrier top is folded and sealed. Such an operation can be carried out by hand or by appropriate packaging machinery.

It will be recognized that many variations may be made to the foregoing within the scope of the present invention. For example, the design of the carrier may be enhanced through the addition of handles, billboard flaps and the like, using structures known and understood within the art. Further, alternate carrier styles may be used, such as those accommodating two rows of bricks rather than the bricks in one row as shown herein. These arrangements with handles, billboards and/or two rows of articles are shown and described in U.S. Pat. Nos. 2,823,062; 2,946,436; and 5,135,104 which are hereby incorporated by reference.

It should be further recognized that it would be possible to replace the top wall panel 22 with a strap handle extending transversely across the top of the group of the packaged bricks and connecting between the upper edges of the side wall panels 24 and 32.

It should be still further recognized that while each of the retention strips 36, 38, 40, 42, 44 and 46 is engaged beneath the end portion of the seam of the respective brick, it may be that each retention strip is designed to have an upper edge complementary to the lower edge of the triangular end portion 20 of the respective brick to snugly engage such an lower edge.

Other modifications may be made in the foregoing without departing from the scope and spirit of the claimed invention.

What is claimed is:

1. A carrier for a brick-type container, the brick including interconnected side and end walls, and an upper closure structure having folded portions overlapping and extending downwardly along a portion of each of said end walls, the carrier comprising:

a top wall panel;

a pair of side wall panels foldably connected to said top wall panel;

a pair of retention strips substantially vertically disposed and extending between said side wall panels, each said retention strip defining an upper free edge spaced from said top wall panel; and means for foldably connecting said retention strips and said side wall panels, whereby said side wall panels and said retention strips together surround the brick and said free edges engage a lowermost end of the folded portions of the upper closure structure of the brick.

2. A carrier as defined in claim 1, wherein said foldably connecting means includes a pair of gusset panels for each of said retention strips, one of said gusset panels of each pair connecting said retention strip with one of said side wall panels.

3. A carrier as defined in claim 2, wherein said gusset panels are of generally triangular configuration and are foldably connected to said retention strip so as to be positioned in overlapping relationship with the associated one of said side wall panels.

4. A carrier for two or more brick-type containers, each brick including interconnected side and end walls and an upper closure structure having folded portions overlapping and extending downwardly along a portion of each of said end walls, the bricks being disposed linearly in end-wall to end-wall arrangement, the carrier comprising:

a top wall panel;

a pair of side wall panels foldably connected to said top wall panel;

first and second retention strips substantially vertically disposed and extending between said side wall panels at opposite ends of said side wall panels;

third and fourth retention strips substantially vertically disposed and positioned in mutually overlapped relationship, said third and fourth retention strips extending between said side wall panels and being disposed intermediate said first and second retention strips;

said retention strips each defining an upper free edge spaced from said top wall panel; and means for foldably connecting said retention strips and said side wall panels, whereby said side wall panels and said first and third retention strips surround one of the bricks and said side panels and said second and fourth retention strips surround the other one of the bricks, said free edges of said retention strips each engaging a lowermost end of the respective one of the folded portions of the upper closure structure of the bricks.

5. A carrier as defined in claim 4, wherein said foldably connecting means includes a pair of gusset panels for each of said retention strips, one of said gusset panels of each pair connecting said retention strip with one of said side wall panels.

6. A carrier as defined in claim 5, wherein said gusset panels are of generally triangular configuration and are foldably connected to said retention strip so as to be positioned in overlapping relationship with the associated one of said side wall panels.

7. A carrier as defined in claim 4, wherein said second and third retention strips are connected along a lower edge thereof by a fold line.

8. A package comprising:

a container including a pair of side walls interconnected by a pair of end walls, and an upper closure structure having folded portions overlapping and extending downwardly along a portion of each of said end walls; and a carrier disposed on said container and including means for engaging said folded portions of said upper closure structure such that said container and said carrier are retained together when said carrier is lifted.

9. A package as defined in claim 8, wherein said carrier comprises a pair of side wall panels disposed alongside said side walls of said container, and said engaging means comprises a pair of retention strips connecting and extending between said side wall panels and disposed under respective lower edges of said folded portions.

10. A package as defined in claim 9, wherein said retention strips are disposed substantially vertically along said end walls of said container and having upper edges for engaging said lower edges of said folded portions.

11. A package as defined in claim 9, wherein said carrier further comprises a top wall panel disposed over a top of said container and foldably connected to said side wall panels along upper edges thereof.

12. A package as defined in claim 9, wherein said carrier further comprises a pair of gusset panels interconnecting each of said retention strips with said side wall panels.

13. A package as defined in claim 12, wherein said gusset panels for said each retention strip are foldably connected respectively to said side wall panels so as to be positioned in overlapping relationship with said side wall panels respectively.

* * * * *